United States Patent [19]

Hodson

[11] Patent Number: 4,966,490

[45] Date of Patent: Oct. 30, 1990

[54] APPARATUS FOR USE IN APPLYING A THIN RESINOUS COATING TO EXISTING SURFACES

[76] Inventor: James V. Hodson, 1650 E. 500 South, Fruit Heights, Utah 84037

[21] Appl. No.: 436,809

[22] Filed: Nov. 13, 1989

[51] Int. Cl.[5] ..... E01C 19/22; E01C 19/41; E01C 19/48

[52] U.S. Cl. ..... 404/103; 404/105; 404/110; 404/118; 118/103; 118/118

[58] Field of Search ..... 404/96, 101–105, 404/108, 110–114, 118–120, 122; 118/103, 108, 111, 207; 425/63–65, 219, 90

[56] References Cited

U.S. PATENT DOCUMENTS

| | | | |
|---|---|---|---|
| 2,134,689 | 11/1938 | French | 404/102 |
| 3,272,098 | 9/1966 | Buchholtz et al. | 404/32 |
| 3,423,492 | 1/1969 | Jonell et al. | 425/63 |
| 3,801,421 | 4/1974 | Allen et al. | 404/19 |
| 3,957,832 | 5/1976 | Bressler et al. | 528/104 |
| 4,280,800 | 7/1981 | Bunn | 425/64 |
| 4,293,682 | 10/1981 | Kluger et al. | 528/123 |
| 4,320,988 | 3/1982 | Seal | 404/118 |
| 4,507,015 | 3/1985 | Furukawa et al. | 404/110 |
| 4,648,741 | 3/1987 | Allen | 404/119 |
| 4,722,636 | 2/1988 | Brock | 404/118 |

*Primary Examiner*—Bruce M. Kisliuk

[57] ABSTRACT

A device for use in applying a thin resinous coating to existing surfaces, such as concrete highways, to resurface and restore the same and improve their physical properties, such as skid resistance comprising two parallel supporting beams, a screed box having a bottom, two sides and a front and back sides, the bottom of which is attached to the parallel beams and the screed box having an adjustable dispersing gate at the back adapted to dispensing a controlled amount of the resinous binder in the box, at least one rotatable screed brush adjustably attached between the two beams behind the screed box and being adapted to bringing the dispersed binder in contact with the surface and pushing out any air that may be trapped under the coating, at least two spaced levelling bars perpendicularly and adjustably attached between the beams and being adapted to spreading and levelling the binder passing under the brush, at least one of the levelling bars being adapted to applying downward pressure on the layer of binder applied to the surface.

7 Claims, 2 Drawing Sheets

APPARATUS FOR USE IN APPLYING A THIN RESINOUS COATING TO EXISTING SURFACES

BACKGROUND OF THE INVENTION

1. Field of the Invention

This invention relates to a new type of apparatus for use in applying a thin resinous coating to existing surfaces to resurface and restore the same.

Specifically, the invention provides an efficient and economical apparatus for use in applying a thin resinous coating to existing surfaces, such as highways and runways, to resurface and restore the same and to improved skid resistance and resistance to further deterioration by use and weather conditions. The new apparatus broadly comprises in combination, two parallel supporting beams adapted to being placed on the surface to be treated and being pulled along on the top of the existing surface and being at such a length as to extend beyond the length of the section of existing surface to be coated, a screed box having a bottom, two sides and a front and back side, the bottom of which is fixedly attached to both of the parallel beams near the front end thereof and the screed box having an adjustable dispensing gate on the back adapted to dispensing on the existing surface a controlled amount of the resinous binder, at least one rotatable screed brush perpendicularly and adjustably attached between the two beams at a distance behind the screed box and being adapted to bringing the resinous binder in contact with the entire existing surface and pushing out any air that may otherwise be trapped under the coating, at least two spaced leveling bars perpendicularly and adjustably attached between the two beams behind the screed brush and being adapted to spreading and leveling the resinous binder passing under the brush, at least one of the leveling bars being adapted to applying downward pressure on the layer of resinous binder passing under the bar and thus effecting a firm bond between the thin resinous binder coating and the surface being treated.

The invention further provides a process for using the above-noted apparatus for resurfacing and restoring existing surfaces which comprises placing the apparatus on the existing surface to be treated with the beams extending at both the front and back ends well beyond the section to be coated so as to effect a substantially level coating on the said surface, placing in the screed box the desired resinous binder composition to be applied as the thin coating, and preferably an epoxy resin composition preferably containing Portland cement, aggregate, water and an epoxy resin curing agent, such as a reaction product of methylene chloride and monoethanol amine, dispensing the said resinous binder from the dispensing gate at the bottom back of the screed box onto the existing surface to be treated, slowly moving the apparatus forward over surface, adjusting the rotatable screed brush so that it pushes the resinous binder in contact with the surface and pushes out any air that may otherwise be trapped under the coating, adjusting at least one of the levelling bars so that it levels the coating to the desired thickness, e.g. $\frac{1}{8}$ to $\frac{3}{8}$ inches thickness, and one of said bars to effect a downward pressure on the thin coating to effect a firm bond with the existing surface.

2. Prior Art

During the past years there has been a great deal of activity in building concrete highways, runways, bridges, and the like throughout the United States. The extreme changes in temperature as well as the addition of icing chemicals, such as salt, and in addition, the increase in the number of heavy trucks and buses, and the like, have caused a great deteriorating effect on the concrete structures, and many of them are now in a weakened condition and badly in need of repair.

Many highway departments are now urgently seeking materials that can be used to restore the deteriorated products, and or materials that can be applied to the products to prevent further deterioration and impart increased resistance to further effect of weather and use. Many methods have been suggested to solve this problem but they all have generally failed to meet the desired need.

It has been proposed in the past to cover the deteriorated surfaces with a thick coating of a synthetic resin, such as a polyester, but this has not been successful because there has been poor adhesion between the concrete and the resinous coating and the coatings have been easily stripped off. In addition, the thick coatings have been easily cracked by the heavy loads applied on top as well as by the expansion and contraction of the sub concrete surface.

Further disadvantage to the use of resinous coatings has been that they have been difficult to apply and set up so rapidly that they could not be utilized for coating of any large area. The equipment available was not adapted to the spreading of the resinous compositions quick enough before the material set up in the mixing equipment.

It is an object of the invention, therefore, to provide a solution to the above-noted difficulty. It is an object of of the invention to provide a new type of equipment which can be used to apply a very thin coating to the deteriorating surfaces which has excellent adhesion to the surfaces and does not crack or easily scaped off. It is a further object to provide an apparatus for the application of a thin coating to deteriorating surfaces which does not crack on expansion and contraction of the sub surface. It is a further object to provide an apparatus for application of resinous compositions to existing surfaces which is easy to operate and effects a very rapid dispersement of the resinous material on the existing surface. It is a further object to provide an apparatus for the dispersement of resinous material to highway surfaces which permits treatment of miles of roadway during a days operation. It is a further object to provide an apparatus which can be used to lay down a very thin resinous coating to a roadway or runway which has outstanding properties, such as skid resistance and resistance to deterioration by the weather. It is a further object to provide an apparatus which can lay down a thin resinous coating at a cost which is a fraction of the cost for conventional repair methods. These and other objects of the invention will be apparent from the following detailed description thereof.

SUMMARY OF THE INVENTION

It has now been discovered that these and other objects can be accomplished by the new apparatus of the present invention which presents for the first time an apparatus that can be used to apply a very thin resinous coating to existing surfaces which coating has outstanding adhesion and superior physical properties.

The new apparatus of the present invention comprises in combination, two parallel supporting beams adapted to being placed on the surface to be treated and being pulled along on the top of the surface and being such a length as to extend beyond the length of the section of existing surface to be treated, a screed box having a bottom, two sides and a front and back side, the bottom of which is fixedly attached to both of the parallel beams near the front end thereof and the screed box having an adjustable dispensing gate on the back adapted to dispensing on the existing surface a controlled amount of the resinous binder, at least one rotatable screed brush perpendicularly and adjustable attached between the two beams at a distance between the screed box and being adapted to bringing the resinous binder in contact with the entire existing surface and pushing out any air that may otherwise be trapped under the coating, at least two spaced levelling bars perpendicularly and adjustably attached between the two beams behind the screed brush and being adapted to spreading and levelling the resinous binder passing under the brush, at least one of the leveling bars being adapted to applying downward pressure on the layer of resinous binder passing under the bar and thus effecting a firm bond between the thin resinous binder coating and the surface being treated.

It has been found that when this special apparatus is used in combination with a special epoxy resin binder composition as described hereinafter one can form a very thin coating of cured resin on the deteriorating surfaces which has outstanding adhesion to the concrete or asphalt surfaces and can withstand heavy weighs and scrapings and pounding without cracking or chipping off. Repeated scrapings by snow plows and the like have failed to destroy the outstanding adhesion obtained by the use of the equipment with the epoxy resin binders. In addition, the thin coatings fail to crack or break due to the expansion and contraction of the subsurfaces and can withstand wide changes of temperature without being disrupted. In addition, the thin coatings have outstanding properties, such as skid resistance and resistance to deterioration by chemicals, etc. All this is accomplished at a fraction of the cost of other known methods of repair.

The results obtained by the use of the above-noted apparatus are quite suprising in view of the past knowledge in the art. It was expected for example that it would be impossible to apply such a thin layer, e.g. $\frac{1}{8}$ to $\frac{3}{8}$ inches in thickness, and still obtain a strong adhesive bond which could not be removed and would still impart the desired superior properties.

DESCRIPTION OF THE DRAWINGS

The various objects and features of the present invention will be more fully understood by reference to the accompanying drawings.

With reference to FIG. 1, the assembled apparatus is shown as 11, the two parallel support beams are shown as 12 and 13, the screed box as 14, the rotatable screed brush as 15, the levelling bar as 16 and 17, with the hydraulic means for rotating and adjusting the screed brush as 18 and 21, the hydraulic means for raising and adjusting the levelling bar 16 as 19 and 22, and the hydraulic means for raising and adjusting the levelling bar 17 as 20 and 23. The adjustable dispensing gate is shown as 24, the guide slots for the raising and lowering of the gate are shown as 35 and 36, and the hydraulic means for the raising and lowering of the gate are shown as 25, 27 and 28. The section of the roadway being treated is shown as 29.

With reference to FIG. 2 which is an end view of a levelling bar, the bar is shown as 16, the hydraulic means for controlling the bar as 19 and the roadway surface being treated as 30.

With reference to FIG. 3 which is an end view of the levelling bar in a controlled position putting downward pressure on the resinous binder as it passes under the bar, the levelling bar in the downward position is shown as 14, the hydraulic control means as 19 and the surface being treated as 30 with the resinous binder being pressed down on the surface as 37.

With reference to FIG. 4 which is an end view of the screed brush, the brush roller is shown as 15, the brushes wrapped around the roller as 31, the hydraulic means for control is shown as 18, the resinous binder being spread out on the roadway as 32 and the roadway surface being treated as 30.

With reference to FIG. 5 which is a cut out section of the finished coating on the roadway illustrating how the coating fills the cuts or crevasses in the roadway and presents a substantially level top coating, the finished coating is shown as 33 and the base roadway with its crevasses is shown as 34.

DETAILED DESCRIPTION OF THE NEW INVENTION

Figure 1:
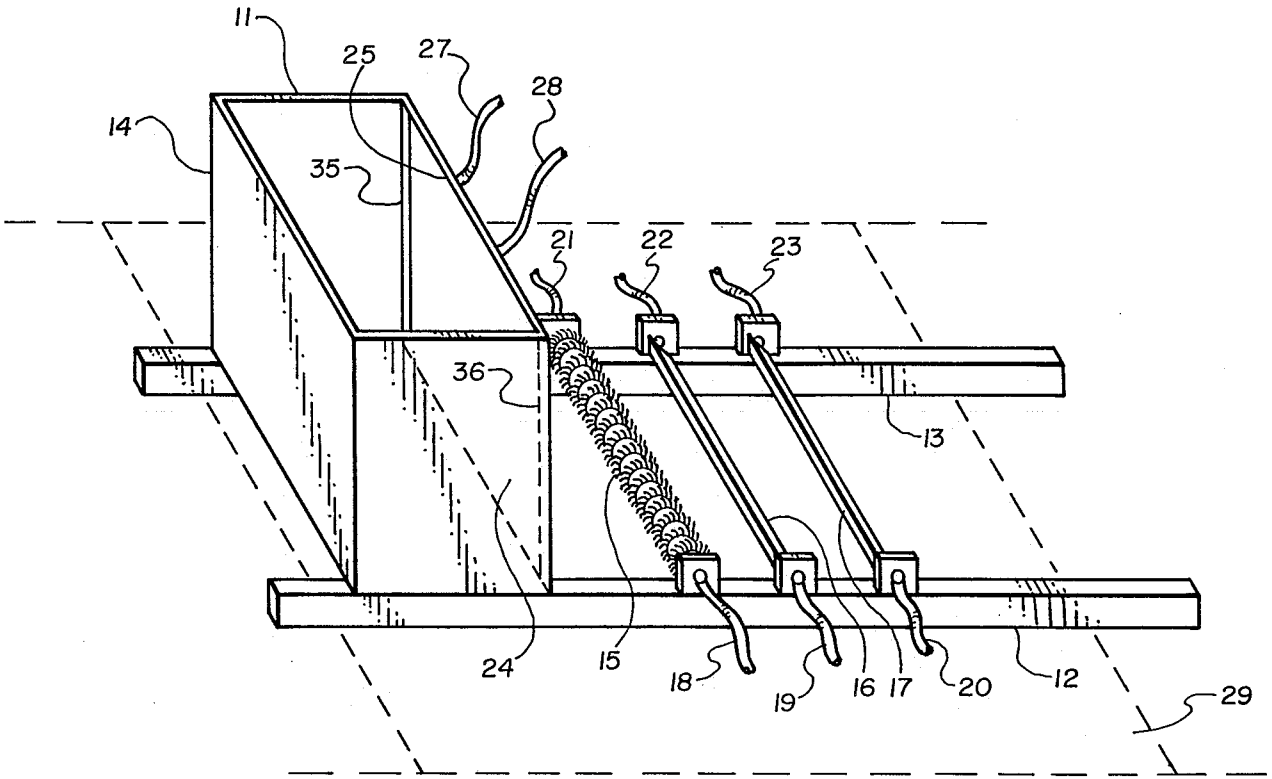
FIG. 1 is a perspective sketch of the new apparatus of the invention.
Figure 2:
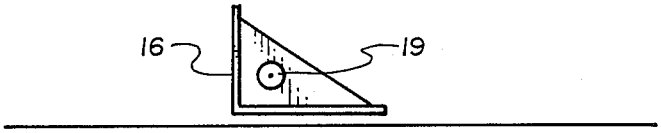
FIG. 2 is an end view of a levelling bar.

While the above-described description of the invention and the attached drawings have been made in rather specific terms, it should be understood that the various changes to either configuration can be made in construction and operation without departing from the scope of the present invention.

The support beams used in preparing the apparatus of the present invention can be of any design and material as long as they provide support for the screed box above the roadway, and are adapted to being pulled along the roadway, are of sufficient length to extend beyond the section of roadway being coated, and supply support for the screed brush and levelling bars.

In order to create a level coating and avoid the formation of dips and an uneven surface, it is important that the beams be in length sufficient to extend over the section of roadway being treated. In most cases such sections as generally divided by expansion joint vary in length from about 15 to 25 feet, and as a result, the beams should extend beyond that length say from from about 20 to 35 feet. They are preferably prepared from steel.

The beams should also be adapted to be pulled along the roadway. This may be accomplished by the addition of small wheels at the front and back ends of the beams, or the beams may simply possess hooks or eyelettes at the front ends where the beams may be engaged by chains or ropes and pulled along the roadway.

The screed box attached to the beams can be of any conventional construction as long as it has sufficient volume for the intended use and has the necessary dispensing gate which can be automatically controlled. Preferred screed boxes generally have a volume of about 250 to 350 cubic feet and dispersing means to apply layers of the binder on the surface in the desired amount. In most instaces, the dispersing means and speed of moving the device are regulated so as to place lays of binder up to about 6 inches at the tray at the bottom of the gate and from there onto the surface.

As the layer of binder passes under the screed brush it is levelled to a layer of about ½ inch in thickness. As the levelled layer then passes under the levelling bars it is pressed down to a thin layer preferably from ¼ to ⅛ inch in thickness.

As noted to accomplish the above, the dispersing gate is automatically controlled, preferably by conventional hydraulic means so that it can be raised and lowered as needed for control as to the right amount to be placed on the roadway.

The screed brush attached to the beams and employed to level out the initial layer of binder and to brush the material down onto the surface and reach any crevasses or deep holes and push out any air that may be contained under the coating may be constructed as need as long as it effects this special purpose. The brushes are preferably nylon brushes and are preferably wound around a steel cylinder which may be from 3 to 6 inches in diameter. The screed brush is also controlled so that it may be raised or lowered as needed according to the type of binder and type of surface being treated. This is preferably accomplished by conventional hydraulic means.

Figure 3:
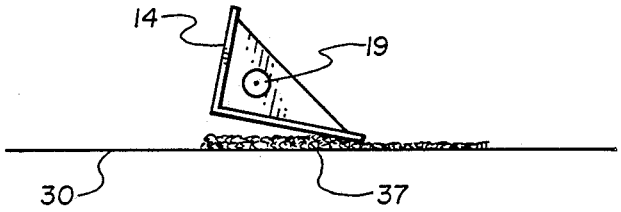
FIG. 3 is an end view of the levelling bar illustrating the bar in a position to put downward pressure on the resinous coating.
Figure 4:
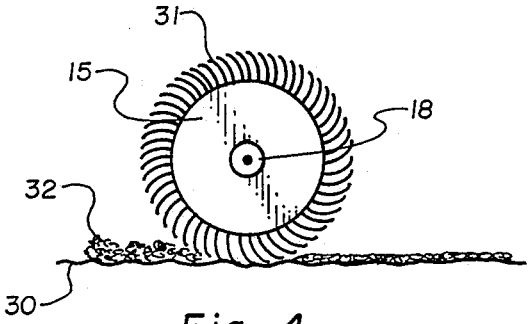
FIG. 4 is an end view of the screed brush illustrating how it functions to force the coating down on the existing surface.
Figure 5:
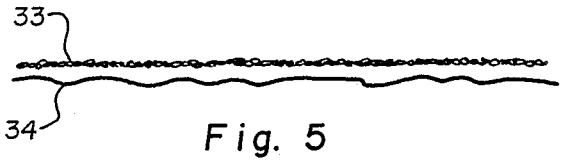
FIG. 5 is a cut out section of the finished coating on the existing roadway illustrating how it fills the cuts or crevasses in the roadway and presents a substantially level top coating.

The levelling bars attached to the beams as noted hereinabove and used to level and apply downward pressure on the layer of binder passing under the screed brush may also be constructed in any desired manner and of any suitable material as long as they accomplish the desired purpose. Preferably the bars are of L shaped steel bars as shown in the drawings with control means, such as hydraulic means at the ends to permit the bars to be raised and lowered as well as placed at an angle as shown in FIG. 3 to effect downward pressure on the layer of binder and effect a firm bond between the binder and the existing surface being treated. In general, placing the levelling bar at an angle varying from about 20° to 30° effects a downward pressure on the binder. Preferred amounts of pressure vary from about 10 to 120 psi.

One of the most serious problems with the deteriorating concrete roadways has been the deep ruts and grooves in the surface caused by excessive wear and weather conditions. To form an effective coating over such surfaces it is essential to force the air out of and the binder into these deepd ruts to effect a strong bond between the binder and roadway. For this purpose the screed brush and the levelling bar with its downward pressure as noted above are very essential to the success of the use of the present invention.

While two levelling bars are shown in the drawings, the number of the bars can be varied as needed. In most cases the two bars are sufficient with one bar being used to effect the levelling and the other bar being used to effect the desired downward pressure, preferably varying from about 10 to 120 psi. Other conventional bars and screeds, such as bunion reversal roll screeds, brushes and trays can be used as desired to increase the efficient and operation of the apparatus.

As noted, an important advantage of the apparatus is to put down very thin coatings of the resinous binder which have never been successfully applied before. In general, the coatings may vary from about ⅛ to ⅜ inches in thickness, but can be thinner or thicker as desired. This thickness is accomplished in the finally stages by the use of the above-noted levelling bars, although all the disclosed features are essential to the successful operation of the apparatus.

The apparatus of the present invention can be used for the application of any type of resinous binder to an existing surface. As noted, the superior results described above are preferably obtained by using an epoxy resin binder composition, and preferably one containing the special curing agents comprising a reaction product of monoethanol amine and methylene chloride. The binder also preferably contains Portland cement, aggregate and water.

The epoxy resins to be used in preparing the superior bindder compositions are those materials possessing more than one vicinal epoxy group, i.e. more than one

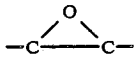

group.

For clarity, many of the epoxy resins referred to as polyepoxides and particularly those of polymeric type are described in some cases in terms of epoxy equivalency. The meaning of this expression is described in U.S. Pat. No. 2,633,458, and so much of that disclosure referring to the epoxy equivalency is incorporated herein by reference. The polyepoxides used in the present invention are those preferably having an epoxy equivalency greater than 1.0.

Various examples of polyepoxides that can be used in the present invention are also given in U.S. Pat. No. 2,633,458 and such examples are incorporated herein by reference.

Examples of polyepoxides to be used in preparing the new binder compositions of the present invention include, among others, the glycidyl ethers, and particularly the glycidyl ethers of phenols and polyhydric alcohols. The glycidiyl ethers of polyhydric phenols are obtained by reacting epichlorohydrin with the desired polyhydric phenol in the presence of alkali. Glycidyl ethers of 2,2-bis(4-hydroxyphenyl)propane in the liquid and solid forms are examples of such glycidyl ethers. Other examples include the glycidyl ethers of 1,1,2,2-tetrakis(4-hydroxphenyl)ethane (epoxy value of 0.45 eq/100 g. and melting point of 85° C.) and polyglycidyl ether of 1,1,5,5-tetrakis(hydroxphenyl) pentane (epoxy value 0.514 eq/100 g.) and the like, and mixtures thereof.

Other examples of polyepoxides include the epoxidized esters of polyethylenically unsaturated monocarboxylic acids, such as epoxidized linseed, soybean, perilla, oiticia, tung, walnut and dehydrated caster oil, methyl linoleate and the like.

Still another group comprise the epoxidized polymers of diolefins, such as butadiene, such as epoxidized butadiene-acrylonitrile copolymers.

The epoxy resin curing agents used in the special binder compositions preferably comprise the reaction product obtained by reacting methylene chloride with monoethanol amine, particularly in special proportions. The amount of the methylene chloride varies from about 80% to 95% by volume and the amount of the monethanol amine varies from about 5% to 20% by volume.

Products are obtained by combining 80% by volume of methylene chloride with 20% by volume of the monoethanol amine. When more than 20% by volume of the monoethanol amine is employed, the product lossses its ability to cure the epoxy resin to the desired hard conditions.

The reaction product is formed by mixing the two components together, preferably at ambient temperature, and allowing the mixture to stand. The resulting product is a liquid reaction product having a viscosity from about 29 to 48 CPS@25° C., a boiling point from about 104° F. to 190° F. and specific gravity between about 19 and 32/25° C. It has good pot life and can be stored for extended periods without loss of curing ability. The curing ability varies widely from the action of the 2 components used separately indicating an interreaction.

The above-described new reaction product curing agents can be used by themselves as curing agents or they can be used in combination with other types of known curing agents. This includes among others, the materials possessing primary and/or secondary amine groups, such as, the aliphatic amines, as ethylene diamine, triethylene tetramine, and the like.

Particularly preferred curing agents to be employed include the amino hydrogen containing polyamides prepared by reacting a polybasic acid with an excess of an aliphatic amine. Particularly preferred are the polyamide compositions derived from polymeric fat acids and aliphatic polyamines. Resins of this general type are disclosed in Cowan et al U.S. Pat. No. 2,450,940. Typical of these polyamides are those made with polymeric fat acids with ethylene diamine and/or diethylene triamine. It is possible to produce resins having terminal amine groups by controlling the proportion of reactants. The amount of free amine groups can be determined by titration. The amine number is defined as the number of milligrams of potassium hydroxide equivalent to the free amine groups present in one gram of the resin. In general, resins having amine groups within the range of 5 to 100 are preferred for the present purpose.

The polymeric fat acids employed in preparing the above-noted polyamides are those resulting from the polymerization of drying or semi-drying oils, or the free acids or simple esters of such acids. Suitable drying or semi-drying oils include soybean, linseed, tung, perilla, oiticia, cottonseed, corn, tall, sunflower, safflower, dehydrated castor oil and the like. The term "polymeric fat acid" as used herein is intended to include the polymerized mixture of acids obtained by polymerization and which mixture generally contains a predominant portion of dimeric acids, a smaller quanity of trimeric and higher polymeric acids, and some residual monomer.

Polyamides coming under special consideration are those having molecular weights between about 1,000 and 10,000 and melting points between 30° C. and 230° C.

Coming under special consideration, particularly because of the very high compressive strengths and water and chemical resistance obtained therewith are the primary amine curing agents. Especially preferred are the primary amines, such as monoethanol amine, tertiary butyl amine, cyclohexylamine, benzylamine, hexamethylenediamine, and the like, and mixtures thereof.

Other ingredients utilized in the special binder compositions of the present invention comprise Portland cement, aggregate and water. The aggregate used may vary over a wide range depending upon the intended use of the finished binder. In general, the aggregate is rather finely divided and has a particle size from about 1/16 to ¾ inch. Preferably at least 80% of the aggregate has a size from about ⅜ to ¼ inch, although larger sizes may be used for some purposes. Examples of such aggregate include crushed rock, crushed shells, crushed quartz, aluminum oxide particles and the like. Paticularly preferred are the minerals, and especially siliceous materials, such as crushed rock. Particularly preferred aggregate is silica sand No. 8 to 30.

The proportions of the ingredients to be used in making the new binder compositions may vary within certain limits. It is important that the methylene chloride makes up at least 40% by volume of the combined mixture of epoxy resin and curing agent, in order to obtain the desired results. The methylene chloride may be that used in forming the reaction product, or additional methylene chloride can be added to bring the amount up to the minimum requirement. If less than 40% by volume is present the mixture may become explosive when held in a closed container.

The amount of the methylene chloride-monoethanol amine product added may vary depending on the intended use and the tupe of fillers employed. In general, the reaction product curing agent will vary from about 15% to 70% by volume, with the epoxy resin varying from about 20% to 70%, and more preferably from about 30% to 60% by volume of the combined mixture of curing agent and epoxy resin.

If any secondary curing agent is employed, it is generally utilized in amounts varying from 5% to 20% by volume and preferably from about 6% to 15% by volume.

The amount of amount of the Portland cement, aggregate and water to be employed may also vary within certain limits. In general when using about 60 to 500 pounds of the above-noted mixture of epoxy resin and curing agent, the Portland cement may vary in amount from about 600 to 800 pounds and the amount of aggregate may vary from about 1000 to 3000 pounds and the amount of water may vary from about 70 to 150 pounds.

The binder composition can be prepared by mixing the components together in the desired proportions. Superior results are generally obtained by mixing the water, cement and aggregate together for about 15 to 30 minutes wet out period and then adding the epoxy resin and curing agent to that mixture and stirring to effect a thorough mixing for about another 10 to 25 minutes to be sure the resin and curing agent are thoroughly dispersed in the water, cement, aggregate composition.

PREFERRED EMBODIMENT OF THE INVENTION

A preferred embodiment of the invention is described below. It should be understood, however, that this is given as a preferred assembly of apparatus for certain purposes and is not to be regarded as limiting the invention in any way.

A resin dispersing apparatus was prepared as follows:

Two iron beams about 20 feet long were selected as the parallel beams. They were placed ten feet apart and a screed box about 12 feet wide, five feet high and four feet long was bolted to the support beams. The screed box had a dispersing gate about 1½ feet high which could be opened in varying distances as needed.

About 2 feet behind the screed box was placed the screed roll brush which had a diameter of about 5 inches and had nylon brush elements having a length of about 1½ inches wound around the brush cylinder. Hydraulic means were employed to raise and lower the brush as needed.

About 2 feet behind the brush was placed a levelling bar which was constructed from steel angle iron of about 3 inches in width. A second levelling bar of similar constructure was placed behind the first levelling bar and hydraulic means attached to permit the bar to be raise or lower and tilted to the right angle as shown in FIG. 3.

Attachment means were placed at the front end of each of the support beams so that a vehicle could pull the apparatus along the existing surface at the desire rate.

The above apparatus was utilized for the application of a thin coat of epoxy resin binder composition to a section of U.S. Highway 15 for a distance of five miles.

This was accomplished as follows: An overlay binder composition was prepared by mixing 20 parts by volume of a methylene chloride-monoethanol amine reaction product curing agent with 20 parts by volume of a liquid glycidyl polyester of 2,2-bis (4-hydroxyphenyl)-propane (Polyether A in U.S. Pat. No. 2,633,458). After stirring together this mixture was combined with 200 parts by volume of Type 3 Portland cement, 400 parts by volume of silica sand NO. 30 and 90 parts by volume of water. This mixture was mixed in a transit mixer for twenty minutes and then poured into the screed box of the above-noted apparatus which had been placed on an outer-section of the concrete highway designated as U.S. Route 15. The apparatus was attached to a truck which pulled the apparatus slowly forward. The dispersing gate was then opened to permit the binder composition to flow out on the existing highway. The leveling bars were set to form a coating of about ⅜ inches thick on the existing surface. The second levelling bar was set at 20 degree angle to effect a downward pressure on the coating and effect a firm bond between the coating and the roadway.

After 10 hours a hard firm coating was obtained which could be open to traffic. Excellent adhesion and wear resistance was obtained. The friction coefficient was raised from 30 to 65 indicating an almost 100% improvement.

I claim as my invention:

1. An apparatus for use in applying a thin resinous coating to existing surfaces to resurface and restore the same comprising in combination, two parallel supporting beams adapted to being placed on the surface to be treated and being pulled along on top of the existing surface a screed box having a bottom, two sides and a front and back side, the bottom of which is fixedly attached to both of the parallel beams and the screed box having an adjustable dispensing gate on the back adapted to dispensing on the existing surface a controlled amount of the resinous binder, at least one rotatable screed brush attached between the two beams at a distance behind the screed box and being adapted to bringing the resinous binder in contact with the entire surface and pushing out any air that may otherwise be trapped under the coating, at least two spaced levelling bars attached between the two beams behind the screed brush and being adapted to spreading and levelling the resinous binder passing under the brush, at least one of the levelling bars being adapted to applying downward pressure on the layer of resinous binder passing under the bar and thus effecting a firm bond between the thin resinous binder coating and the surface to be treated.

2. An apparatus as in claim 1 wherein one of the levelling bars is bevelled downward at an angle of 20° degrees.

3. An apparatus as in claim 1 wherein the support beams are from 20 to 30 feet in length.

4. An apparatus as in claim 1 wherein the dispersing gate, screed brush and levelling bars are adjusted by hydraulic means.

5. An apparatus as in claim 1 wherein means are employed to move the apparatus forward on the existing surface on which it is placed.

6. An apparatus as in claim 1 wherein there are also bunion reverse roll screeds attached to the beams.

7. An apparatus as in claim 1 wherein the levelling bars are capable of being adjusted to level any binder layer out to form a coating between 1/16 and ½ inches in thickness.

* * * * *